US010024061B2

(12) United States Patent
Ainger

(10) Patent No.: US 10,024,061 B2
(45) Date of Patent: Jul. 17, 2018

(54) ROOFING FLASHING

(71) Applicant: JT Roofing Pty Ltd, Kelmscott, WA (AU)

(72) Inventor: James Anthony Ainger, Kelmscott (AU)

(73) Assignee: JT Roofing Pty Ltd, Kelmscott, Western Australia (AU)

( * ) Notice: Subject to any disclaimer, the term of this patent is extended or adjusted under 35 U.S.C. 154(b) by 0 days.

(21) Appl. No.: 15/210,110

(22) Filed: Jul. 14, 2016

(65) Prior Publication Data

US 2017/0037633 A1 Feb. 9, 2017

(30) Foreign Application Priority Data

Jul. 16, 2015 (AU) ..... 2015902817

(51) Int. Cl.
*E04D 13/14* (2006.01)
*E04D 13/147* (2006.01)
*E04D 13/17* (2006.01)

(52) U.S. Cl.
CPC ..... *E04D 13/1476* (2013.01); *E04D 13/17* (2013.01)

(58) Field of Classification Search
CPC ... E04D 13/14; E04D 13/147; E04D 13/1476; E04D 13/17; E04D 1/36
USPC ..... 52/58, 95
See application file for complete search history.

(56) References Cited

U.S. PATENT DOCUMENTS 2,890,642 A * 6/1959 Fernsten ..... E04D 13/1471 138/120
3,593,478 A * 7/1971 Mason ..... E04D 13/17 454/368
4,330,581 A * 5/1982 Borgert ..... E04D 13/1407 428/66.4
4,333,660 A * 6/1982 Cupit ..... E04D 13/1476 277/630
4,386,488 A * 6/1983 Gibbs ..... E04D 13/1407 454/367
4,664,390 A * 5/1987 Houseman ..... E04D 13/1476 277/606
4,730,426 A * 3/1988 Weisner ..... E04D 3/28 52/200
4,909,135 A * 3/1990 Greko ..... F24F 7/02 454/339
2004/0074156 A1* 4/2004 Haynes ..... E04D 1/36 52/58
2004/0168398 A1* 9/2004 Sakno ..... F16L 5/04 52/741.4

(Continued)

*Primary Examiner* — Paola Agudelo
(74) *Attorney, Agent, or Firm* — Duane Morris LLP

(57) ABSTRACT

A roof vent assembly and roof flashing for facilitating a seal between an inclined roof surface having a longitudinal contoured profile and a upstanding vent member extending through said roof surface are disclosed. The roof flashing includes a base plate having respective aprons extending from opposing sides of the base plate, wherein the aprons have a contoured profile conforming to the longitudinal contoured profile of the inclined roof surface and an aperture centrally disposed in the base plate. The aperture is configured to encompass a periphery of the upstanding vent member when the base plate is mounted on the inclined roof surface and the contoured profiles of the aprons are superimposed on the longitudinal contoured profile of the inclined roof surface.

22 Claims, 6 Drawing Sheets

(56) References Cited

U.S. PATENT DOCUMENTS

| | | | | |
|---|---|---|---|---|
| 2005/0044808 | A1* | 3/2005 | Prenn | E04D 13/03 52/200 |
| 2007/0251162 | A1* | 11/2007 | Schmid | E04D 1/365 52/95 |
| 2012/0073239 | A1* | 3/2012 | Haines | E04D 13/1475 52/745.21 |
| 2012/0190288 | A1* | 7/2012 | Willen | E04D 1/30 454/250 |

* cited by examiner

ROOFING FLASHING

TECHNICAL FIELD

A roof vent assembly and a roof flashing therefore are disclosed, Particularly, though not exclusively, a roof vent assembly and a roof flashing therefore for use with inclined corrugated roof surfaces are disclosed.

BACKGROUND

Roof vents are devices that allow moisture, hot air, smoke and fumes to escape from a roof space or from a building interior.

SUMMARY

Generally, a roof vent assembly and a roof flashing therefore are disclosed.

In use, the roof flashing facilitates a seal between an inclined roof surface having a longitudinal contoured profile and a upstanding vent member extending therethrough. The roof flashing comprises a base plate having respective aprons extending from opposing sides of the base plate, wherein the aprons have a contoured profile conforming to the longitudinal contoured profile of the inclined roof surface, and an aperture centrally disposed in the base plate, the aperture being configured to encompass a periphery of the upstanding vent member when the base plate is mounted on the inclined roof surface and the contoured profiles of the aprons are superimposed on the longitudinal contoured profile of the inclined roof surface.

The aperture may be configured to encompass a periphery of a cylindrical vent member. Alternatively, the aperture may be configured to encompass a periphery of a upstanding vent member having a square or rectangular cross-section.

In some embodiments wherein the upstanding vent member is cylindrical, the aperture may define an ellipse having a longitudinally disposed major axis and a transversely disposed minor axis. The minor axis of the ellipse may be marginally greater than an outer diameter of the upstanding vent member. The major axis of the ellipse may be dependent on the angle of inclination of the inclined roof surface and the outer diameter of the upstanding vent member.

In other embodiments wherein a cross-section of the upstanding vent member may be rectilinear, the aperture may define a rectangle having a longitudinally disposed major axis and a transversely disposed minor axis. The minor axis of the rectangular aperture may be marginally greater than an outer transverse dimension of the upstanding vent member. The major axis of the rectangular aperture may be dependent on the angle of inclination of the inclined roof surface and an outer longitudinal dimension of the upstanding vent member.

In one embodiment the base plate may be provided with a plurality of lugs depending from a periphery of the aperture. In use, the plurality of lugs are fixed to an outer surface of the upstanding vent member.

The roof vent assembly for use on an inclined roof surface having a longitudinal contoured profile comprises: an upstanding vent member for extending through said roof surface, and a roof flashing to facilitate a seal between said roof surface and the upstanding vent member, said roof flashing comprising a base plate having respective aprons extending from opposing sides of the base plate, wherein the aprons have a contoured profile conforming to the longitudinal contoured profile of the inclined roof surface, and an aperture centrally disposed in the base plate, the aperture being configured to encompass a periphery of the upstanding vent member when the based plate is mounted on the inclined roof surface and the contoured profiles of the aprons are superimposed on the longitudinal contoured profile of the inclined roof surface.

In one embodiment the roof vent assembly may further comprise a cap member for preventing water ingress through an open upper end of the upstanding vent member. In this particular embodiment, the upstanding vent member may be provided with a plurality of lugs. The plurality of lugs may extend from an upper rim of the upstanding vent member. In use, the lugs may be fixed to the cap member.

In some embodiments, the upstanding vent member may be provided with a plurality of ventilation holes in an upper portion thereof.

BRIEF DESCRIPTION OF DRAWINGS

Notwithstanding any other forms which may fall within the scope of the roof flashing and roof vent assembly as set forth in the Summary, specific embodiments will now be described, by way of example only, with reference to the accompanying drawing in which.

DESCRIPTION OF EMBODIMENTS

Figure 1:
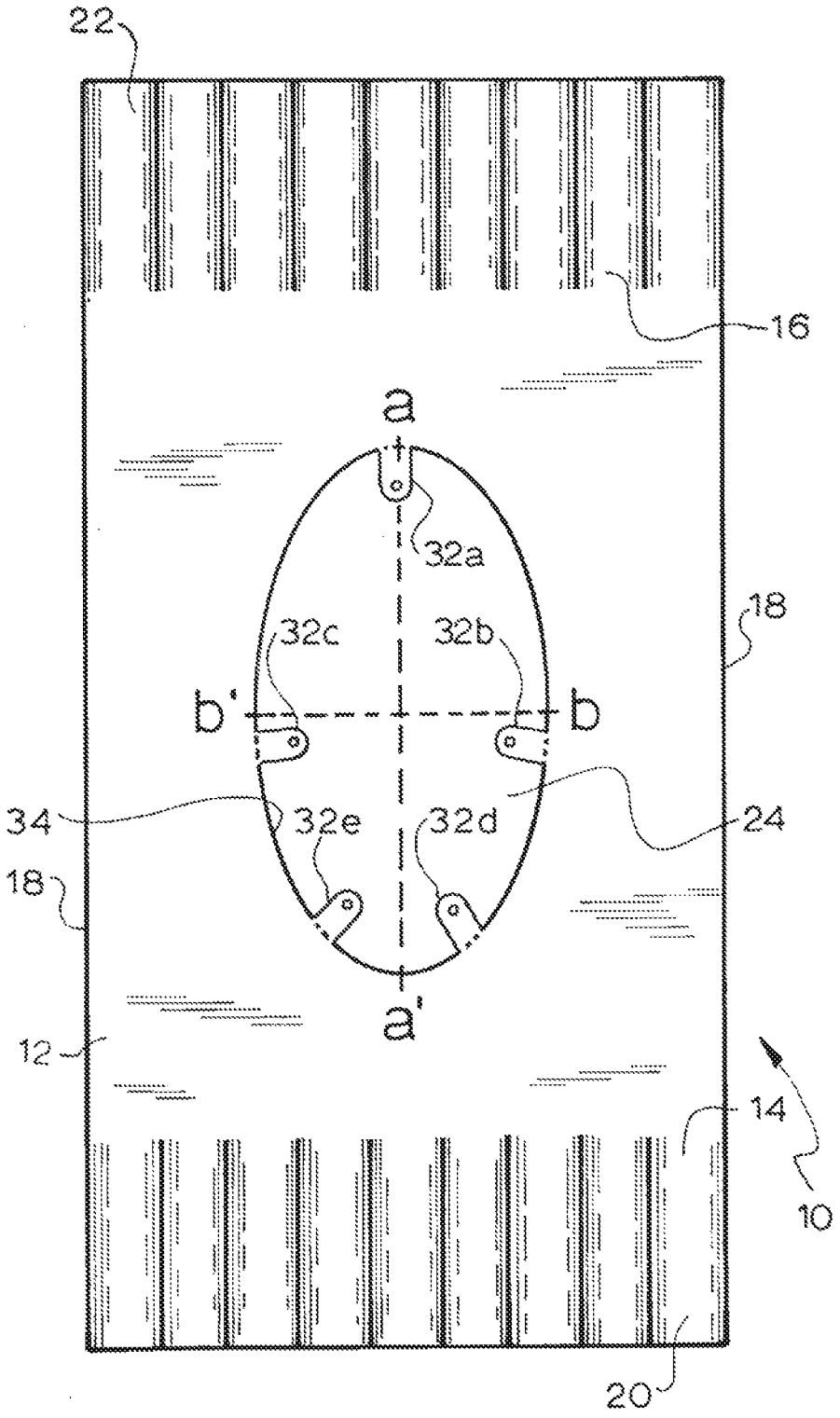
FIG. 1 is a plan view of one embodiment of a roof flashing in accordance with the disclosure.

Embodiments of a roof flashing and a roof vent assembly will now be described by way of example only.

Referring to the figures wherein like parts are referred to by like reference numerals throughout, there is shown embodiments of a roof flashing 10 and a roof vent assembly 100.

In use, the roof flashing 10 facilitates formation of a seal between an inclined roof surface 200 having a longitudinal contoured profile and an upstanding vent member 110 extending therethrough.

The roof flashing 10 includes a base plate 12 having an upper edge 14, a lower edge 16, and opposing side edges 18. The base plate 12 is provided with an upper apron 20 which is integral with and extends from the upper edge 14 of the base plate 12, a lower apron 22 which is integral with and extends from the lower edge 16 of the base plate 12, and an aperture 24 centrally disposed in the base plate 12.

The upper and lower aprons 20, 22 have a contoured profile which is selected to conform to a longitudinal contoured profile of the roof surface 200.

The longitudinal contoured profile of the roof surface 200 may be any one of several types which are well known to a person skilled in the art including, but not limited to, corrugated profile, trapezoid corrugated profile, fluted profile, square-fluted profile, and trapezoid fluted profile. Suitable examples of corrugated profiles include, but are not limited to, Custom Orb® and Mini-Orb®; suitable examples of trapezoid corrugated profiles include, but are not limited to, Lysaght Spandek®; suitable examples of square-fluted profiles include, but are not limited to, Lysaght Trimdek®; suitable examples of trapezoid fluited profiles include, but are not limited to, Spanrib®.

Accordingly, the contoured profile of the upper and lower aprons 20, 22 may be selected from a group comprising corrugated profile, trapezoid corrugated profile, fluted profile, square fluted profile, and trapezoid fluted profile. In one embodiment, the contoured profile is press-formed in the upper and lower aprons 20, 22.

Figure 2:
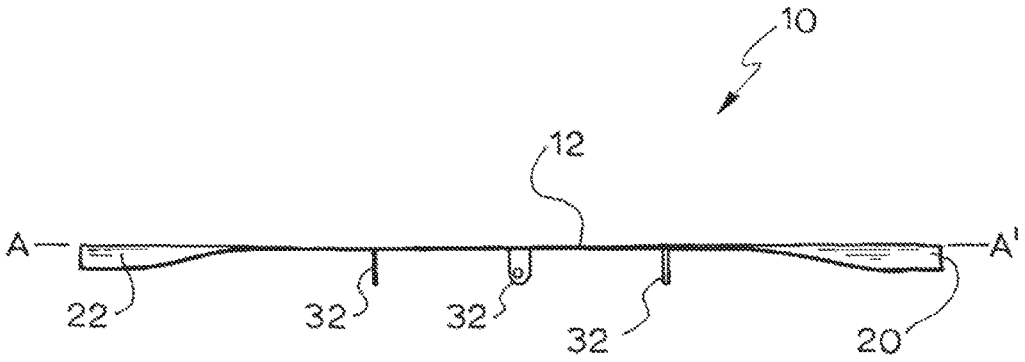
FIG. 2 is a side view of the roof flashing shown in FIG. 1.
Figure 3:
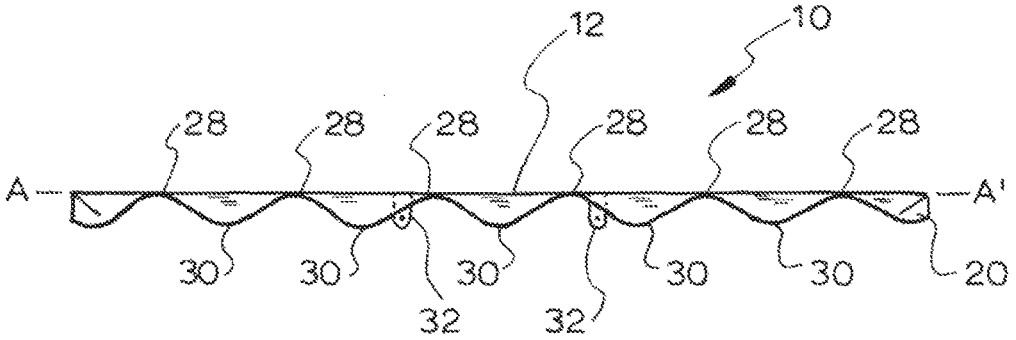
FIG. 3 is an end view of the roof flashing shown in FIGS. 1 and 2
Figure 4A:
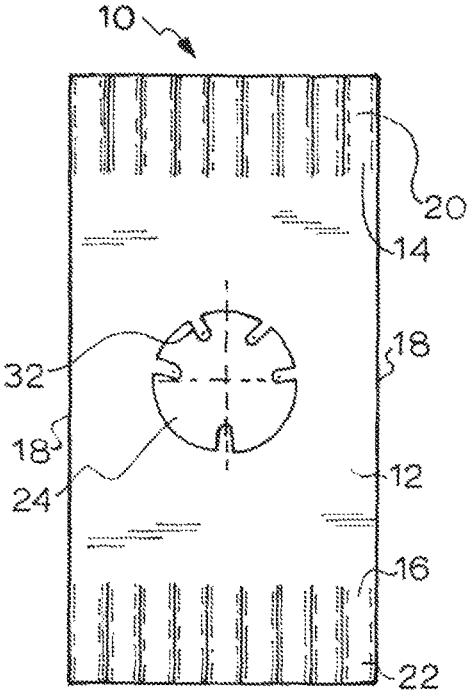
FIGS. 4*a-d* are a series of plan views of several embodiments of a roof flashing configured for use on a roof surfaces with apertures adapted for cylindrical upstanding vent members and roofs of different pitch angles.
Figure 4B:
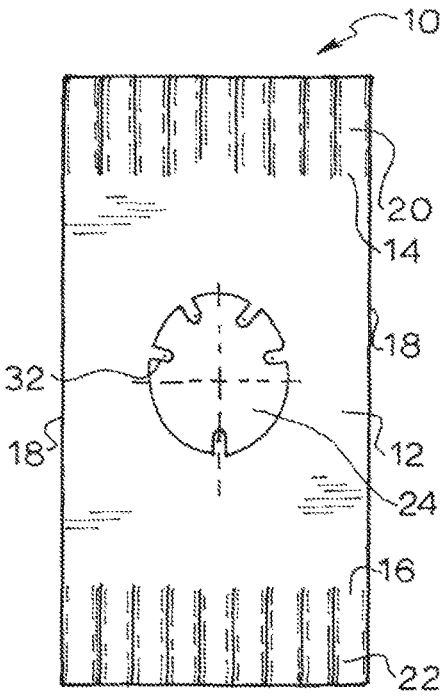
Figure 4C:
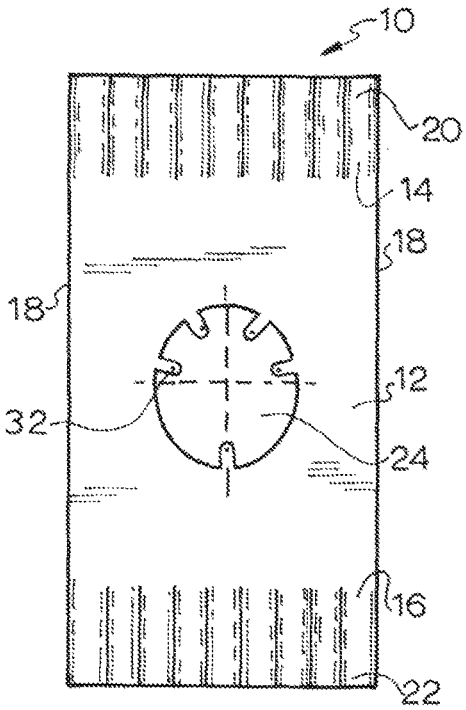
Figure 4D:
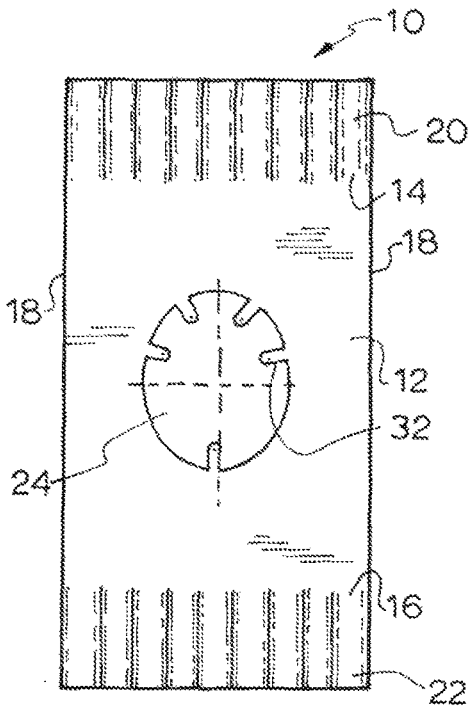

In some embodiments, the contoured profiles of the upper and lower aprons 20, 22 are disposed below a plane A-A' of the base plate 12. In the particular embodiment shown in FIGS. 2 and 3 the respective crests 28 and troughs 30 of the corrugated contoured profile are disposed substantially below the plane A-A' of the base plate 12. In this way, when the roof flashing 10 is mounted on the roof surface 200, the contoured profile of the upper and lower aprons 20, 22 may be superimposed on the longitudinally contoured profile of the roof surface 200, thereby ensuring superior sealing between the roof surface 200 and the roof flashing 10. Additionally, this avoids the pooling of water run-off proximal to a penetration aperture 210 in the roof surface 200 for the upstanding vent member 110.

The aperture 24 in the base plate 12 may be configured to encompass a periphery 112 of the upstanding vent member 110 when the base plate 12 is mounted on the inclined roof surface 200 and the contoured profiles of the upper and lower aprons 20, 22 are superimposed on the longitudinal contoured profile of the inclined roof surface 200.

The upstanding vent member 110 may be cylindrical or have a rectilinear cross-section. In use, the upstanding vent member 110 may penetrate the roof surface 200 and extend substantially vertically through the penetration aperture 210 in the roof surface 200. It will be appreciated, therefore, that the periphery 112 of the upstanding vent member 110 which the aperture 24 of the roof flashing 10 is configured to encompass will vary depending on the angle of inclination ($\alpha$) of the roof surface 200. In other words, the periphery 112 of the upstanding vent member 110 will not be circular (in the case of a cylindrical upstanding vent member 110) or rectilinear having the same outer dimensions as the rectilinear upstanding vent member 110 unless the angle of inclination ($\alpha$) of the roof surface 200 is 0°.

The roof surface 200 may be inclined at any suitable angle from the horizontal for construction of a roof. In one embodiment the roof surface 200 may be inclined at an angle ($\alpha$) of 5-10°, preferably 7.5°. In another embodiment the roof surface 200 may be inclined at an angle ($\alpha$) of 18-22°, preferably 20°. In a further embodiment the roof surface 200 may be inclined at an angle ($\alpha$) of 23-27°, preferably 25°. In another further embodiment the roof surface 200 may be inclined at an angle ($\alpha$) of 28-32°, preferably 30°.

In some embodiments wherein the upstanding vent member 110 is cylindrical, the aperture 24 may define an ellipse having a longitudinally disposed major axis a-a' and a transversely disposed minor axis b-b'. The minor axis b-b' of the ellipse may be marginally greater in length than an outer diameter of the cylindrical upstanding vent member 110. The length (h) of the major axis a-a' of the ellipse may be dependent on the angle of inclination ($\alpha$) of the inclined roof surface 200 and the outer diameter (OD) of the cylindrical upstanding vent member 110 according to Equation (1).

$$h = \mathrm{OD}/\mathrm{cosine}(\alpha) \quad (1)$$

In other embodiments wherein a cross-section of the upstanding vent member 110 may be rectilinear, the aperture 24 may define a rectangle having a longitudinally disposed major axis a-a' and a transversely disposed minor axis b-b'. The minor axis b-b' of the rectangular aperture 24 may be marginally greater in length than an outer transverse dimension (d) of the rectilinear upstanding vent member 110. The length (h) of the major axis a-a' of the rectangular aperture 24 may be dependent on the angle of inclination ($\alpha$) of the inclined roof surface 200 and an outer longitudinal dimension (D) of the rectilinear upstanding vent member 110 according to Equation (2).

$$h = D/\mathrm{cosine}(\alpha) \quad (2)$$

The base plate 12 of the roof flashing 10 may be provided with a plurality of lugs 32 depending from a periphery 34 of the aperture 24. In the embodiment shown in the Figures, five lugs 32*a-e* are disposed around the periphery 34 of the aperture 24. Lug 32*a* is disposed in alignment with major axis a-a' proximal the lower apron 22. Lugs 32*b*, 32*c* are disposed on opposing sides of the periphery 34 of the aperture 24 proximal the minor axis b-b' and the upper apron 20. Lugs 32*d*, 32*e* are disposed on opposing sides of the periphery 34 of the aperture 24 proximal the major axis a-a' and the upper apron 20. In use, the lugs 32 are folded downwards and fixed to an outer surface 114 of the upstanding vent member 110 with suitable fasteners such as rivets or screws.

Figure 6:
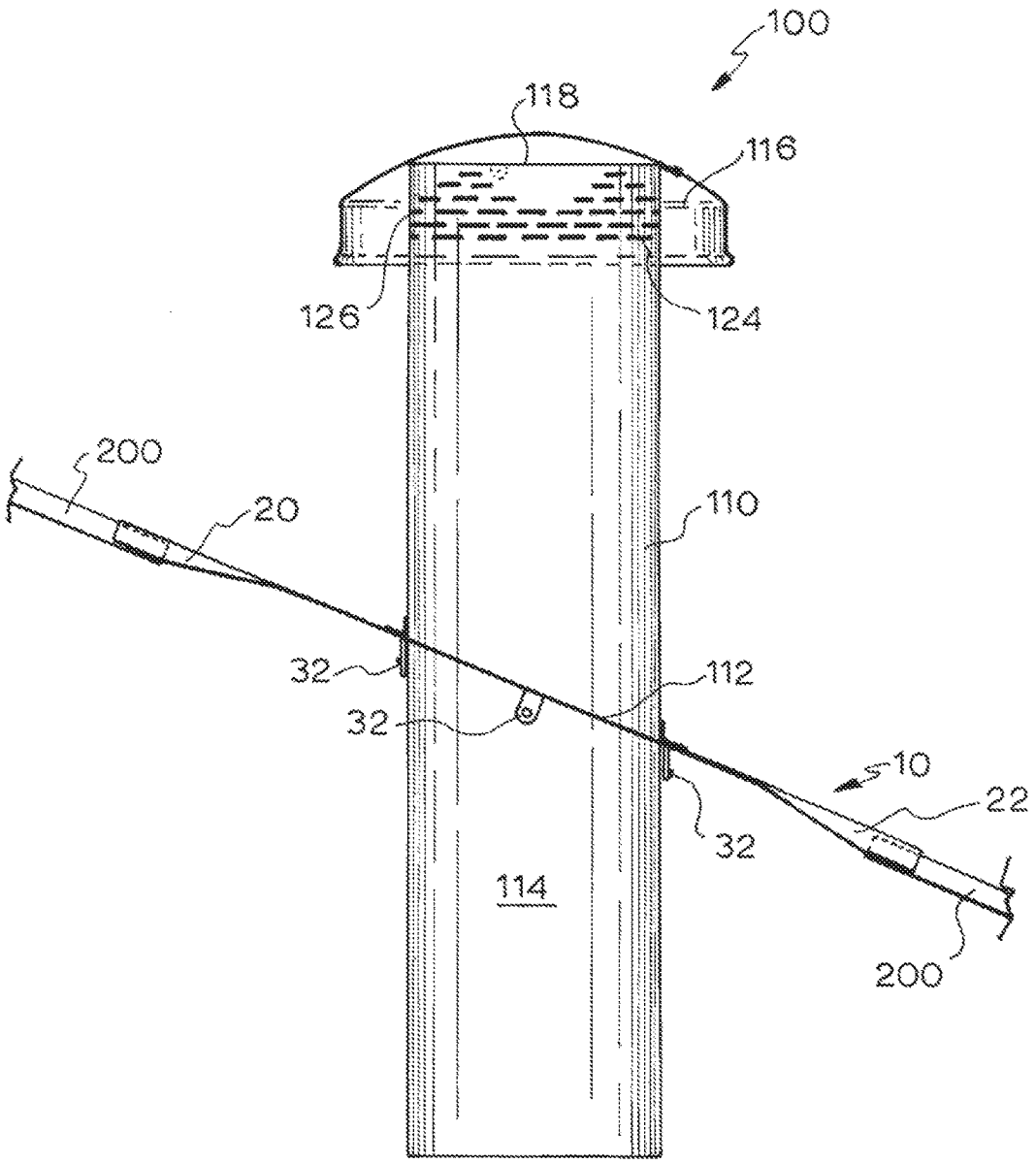
FIG. 6 is a side view of one embodiment of a roof vent assembly in accordance with the disclosure; and, FIG. 7 is a perspective view of the roof vent assembly shown in FIG. 6 installed on an inclined roof surface having a longitudinally contoured profile.
Figure 7:
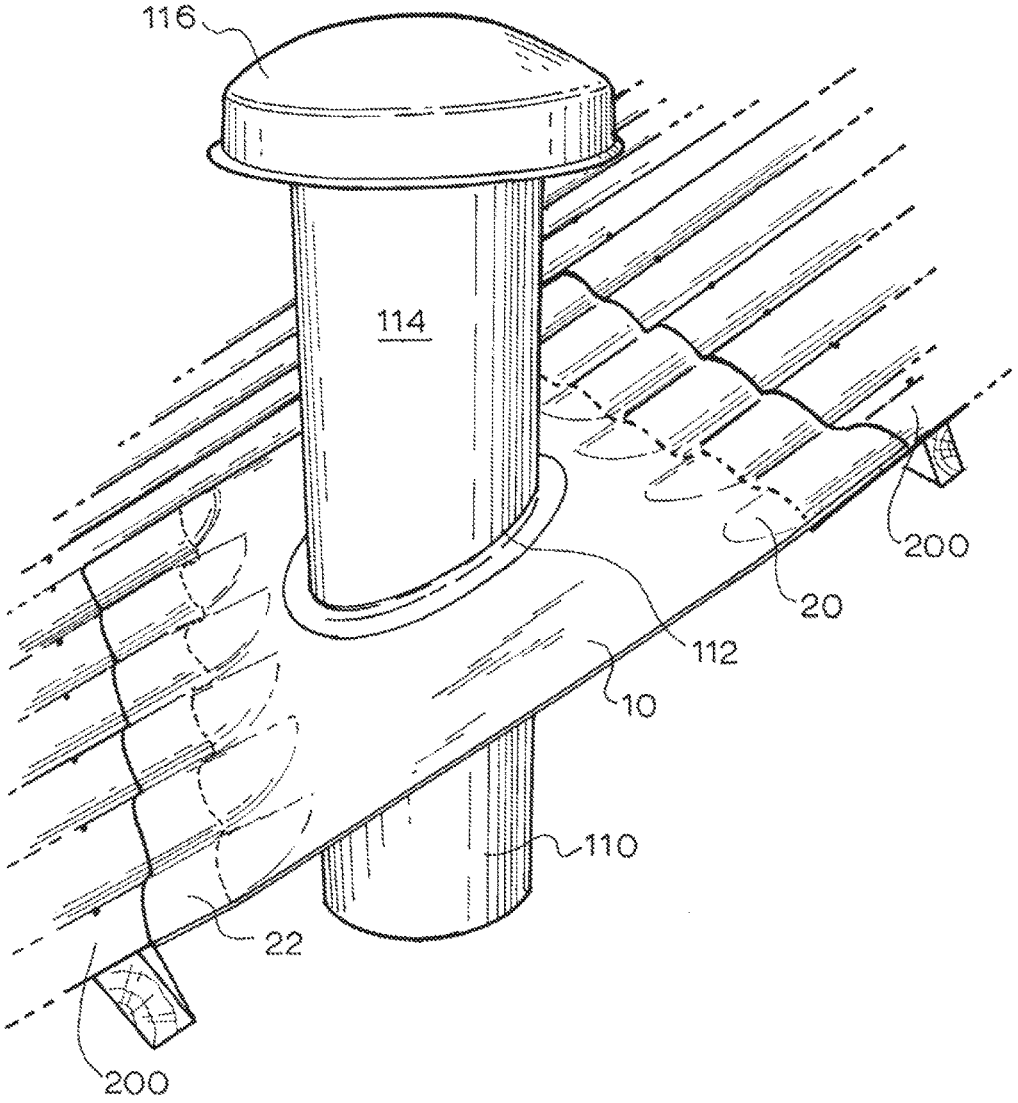

Referring to FIGS. 6 and 7 there is shown a roof vent assembly 100 for use on an inclined roof surface 200 having a longitudinal contoured profile. The roof vent assembly 100 includes the roof flashing 10 as described in the preceding paragraphs and an upstanding vent member 110 as described previously. The roof vent assembly 100 may further include a cap member 116 for preventing water ingress through an open upper end 118 of the upstanding vent member 110.

The upstanding vent member 110 may be provided with a plurality of lugs 120. The plurality of lugs 120 may extend from an upper rim 122 of the upstanding vent member 110. The plurality of lugs 120 may be regularly spaced around the upper rim 122. In use, the plurality of lugs 120 are folded inwardly and fixed to an underside of the cap member 116 with suitable fasteners such as rivets or screws.

Figure 5:
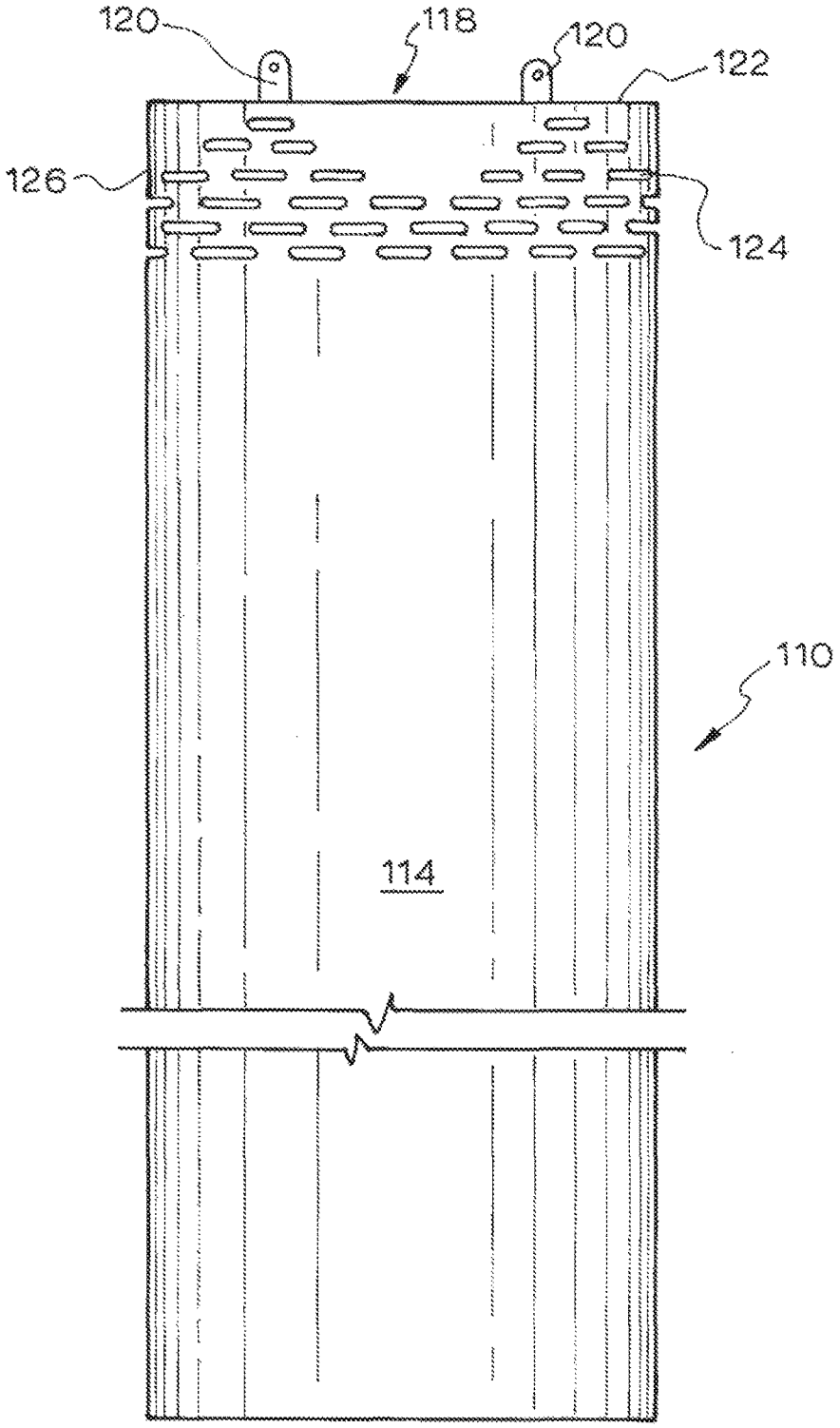
FIG. 5 is a side view of one embodiment of an upstanding vent member in accordance with the disclosure.

The upstanding vent member 110 may be provided with a plurality of ventilation holes 124 in an upper portion 126 thereof. The plurality of ventilation holes 124 may be configured in a repeating pattern around the upper portion 126, such as shown in FIGS. 5 and 6. Typically, the repeating pattern will comprise fewer ventilation holes 124 adjacent the upper rim 122 of the upstanding vent member 110 so as not to compromise the strength and rigidity of the upstanding vent member 110 adjacent the upper rim 122.

Embodiments of the roof flashing 10 may be fabricated from any suitable rigid material including, but not limited to, metals such as aluminum or steel, or alloys thereof, in particular rigid materials used to fabricate roof sheeting having a longitudinal contoured profile.

In one embodiment, the roof flashing 10 may be fabricated in a multi-stage continuous press-forming operation. A sheet from a roll of continuous sheet material may be fed to a press-forming apparatus and disposed between respective upper toolings and lower toolings configured to press-form the selected contoured profile of the upper and lower aprons 20, 22 in the continuous sheet material.

In a first step 300 of the fabrication process, a first of the upper and lower toolings may be arranged to press-form the selected contoured profile of the upper apron 20 or the lower apron 22 of two adjacent roof flashings 10 in the continuous sheet material.

In subsequent step 302, the sheeting is then run through the press-forming apparatus and a second of the upper and lower toolings may be arranged to press-form the selected contoured profile of the other of the upper or lower aprons 20, 22 of two adjacent roof flashings 10 formed in the continuous sheet material. The aperture 24 may be cut with suitable cutting tooling from the continuous sheet material simultaneously with step 302.

Finally, in step 304, the sheeting is cut with a guillotine-like apparatus to cut between adjacent roof flashings 10 disposed in the continuous sheet material.

The aperture 24 may be cut with suitable cutting tooling from the continuous sheet material simultaneously with any one of steps 300, 302 or 304. Alternatively, the aperture 24 may be cut subsequent to step 300 or 302 with said cutting tooling.

The cap member 116 for the roof vent assembly 100 may be formed in a deep-drawing press using an air cushion to apply clamping pressure to a sheet metal blank. The sheet metal blank is placed in the press and stretched over a dome-shaped tool until a desired depth is obtained. Excess overhanging sheet metal is trimmed with a trimming tool.

The roof vent assembly 100 may be assembled by configuring a jig to the desired angle of inclination (α) (i.e. pitch) of the roof. The roof flashing 10 is mounted on the jig and the lugs 32*a-e* depending from the periphery of the aperture 24 are folded downwardly to all the upstanding vent member 110 to be inserted into the aperture 24 so that the aperture 24 encompasses the periphery of the roof vent member 110. A suitable sealant, such as silicone, may be applied to seal any gap between the periphery of the upstanding vent member 110 and the periphery of the aperture 24. The lugs 32*a-e* are then fixed to the outer surface of the roof vent member 110 with suitable fasteners such as rivets or screws to secure the upstanding vent member 110 to the roof flashing 10 and prevent slippage therebetween. The cap member 116 may be fixed to the upper rim 122 of the upstanding vent member 110 by folding the plurality of lugs 120 around the upper rim 122 inwardly and fixing them to an underside of the cap member 116 with suitable fasteners such as rivets or screws.

The roof vent assembly 100 may be installed as follows. The roof surface 200 is marked up and a suitably sized roof penetration (i.e. an aperture in the roof surface 200) is cut into the roof surface 200 at the desired location. The roof surface 200 around the roof penetration is then turned up and the roof vent assembly 100 is inserted into the roof penetration until the base plate 12 is mounted on the inclined roof surface 200 and the contoured profiles of the upper and lower aprons 20, 22 are superimposed on the longitudinal contoured profile of the inclined roof surface 200. A sealant, such as silicone, may be applied to either an underside of the upper and lower aprons 20, 22 or the roof surface 200 itself to provide a seal therebetween. The roof flashing 10 may be further secured to the roof surface 200 with fastening means, such as rivets or screws, inserted through pre-drilled fixing holes therein.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the apparatus and method disclosed herein.

The invention claimed is:

1. A roof flashing fabricated from a rigid material for facilitating a seal between an inclined roof surface having a longitudinal contoured profile and an upstanding vent member extending therethrough, said roof flashing comprising a flat planar base plate having respective aprons extending laterally from opposing sides of the flat planar base plate, wherein the aprons have a contoured profile with a plurality of crests and troughs conforming to the longitudinal contoured profile of the inclined roof surface and the plurality of crests of the contoured profile of the aprons are in lateral alignment with a plane of the flat planar base plate such that the plurality of troughs of the contoured profile of the aprons are disposed below the plane of the flat planar base plate, and an aperture centrally disposed in said base plate, the aperture being configured to encompass a periphery of the upstanding vent member when the roof flashing is mounted on the inclined roof surface and the contoured profiles of the aprons are superimposed on the longitudinal contoured profile of the inclined roof surface.

2. The roof flashing according to claim 1, wherein the aperture is configured to encompass a periphery of a cylindrical vent member.

3. The roof flashing according to claim 2, wherein the aperture defines an ellipse having a transversely disposed minor axis and a longitudinally disposed major axis.

4. The roof flashing according to claim 3, wherein the minor axis has a length marginally greater than an outer diameter (OD) of the upstanding vent member and the major axis has a length (h) dependent on an angle of inclination (α) of the inclined roof surface and the outer circumference of the upstanding vent member, wherein length (h) equals OD/cosine(α).

5. The roof flashing according to claim 1, wherein the aperture is configured to encompass a periphery of an upstanding vent member having a square or rectangular cross-section.

6. The roof flashing according to claim 5, wherein the aperture defines a rectangle having a longitudinally disposed major axis and a transversely disposed minor transverse axis.

7. The roof flashing according to claim 6, wherein the minor axis has a length marginally greater than an outer transverse dimension of the upstanding vent member and the major axis has a length (h) dependent on an angle of inclination (α) of the inclined roof surface and the outer longitudinal dimension (D) of the upstanding vent member, wherein length (h) equals D/cosine(α).

8. The roof flashing according to claim 1, wherein the base plate is provided with a plurality of lugs depending from a periphery of the aperture configured, in use, to attach to the upstanding vent member.

9. The roof flashing according to claim 1, wherein the contoured profile of the aprons is selected from a group comprising corrugated profile, trapezoid corrugated profile, fluted profile, square fluted profile, and trapezoid fluted profile.

10. A roof vent assembly for use on an inclined roof surface having a longitudinal contoured profile comprising an upstanding vent member for extending through said roof surface, and a roof flashing according to claim 1.

11. The roof vent assembly according to claim 10, further comprising a cap member for preventing water ingress through an open upper end of the upstanding vent member.

12. The roof vent assembly according to claim 11, wherein the upstanding vent member is provided with a plurality of lugs configured, in use, to attach to the cap.

13. The roof vent assembly according to claim 12, wherein the plurality of lugs extend from an upper rim of the upstanding vent member.

14. The roof flashing according to claim 10, wherein the base plate is provided with a plurality of lugs depending from a periphery of the aperture.

15. The roof flashing according to claim 10, wherein the contoured profile of the aprons is selected from a group comprising corrugated profile, trapezoid corrugated profile, fluted profile, square fluted profile, and trapezoid fluted profile.

16. The roof vent assembly according to claim 10, wherein the upstanding vent member is provided with a plurality of ventilation holes in an upper portion thereof.

17. The roof vent assembly according to claim 10, wherein the aperture is configured to encompass a periphery of a cylindrical vent member.

18. The roof vent assembly according to claim 17, wherein the aperture defines an ellipse having a transversely disposed minor axis and a longitudinally disposed major axis.

19. The roof flashing according to claim 18, wherein the minor axis has a length marginally greater than an outer diameter of the upstanding vent member and the major axis has a length dependent on an angle of inclination of the inclined roof surface and the outer circumference of the upstanding vent member.

20. The roof flashing according to claim 10, wherein the aperture is configured to encompass a periphery of an upstanding vent member having a square or rectangular cross-section.

21. The roof flashing according to claim 20, wherein the aperture defines a rectangle having a longitudinally disposed major axis and a transversely disposed minor transverse axis.

22. The roof flashing according to claim 21, wherein the minor axis has a length marginally greater than an outer transverse dimension of the upstanding vent member and the major axis has a length dependent on an angle of inclination of the inclined roof surface and the outer longitudinal dimension of the upstanding vent member.

* * * * *